US006564588B1

(12) United States Patent
Nonnenmacher et al.

(10) Patent No.: US 6,564,588 B1
(45) Date of Patent: May 20, 2003

(54) METHOD FOR PRODUCING TUBULAR KNITTED ARTICLES ON A FLAT KNITTING MACHINE

(75) Inventors: Thomas Nonnenmacher, Pliezhausen (DE); Henning Schmidt, Reutlingen (DE); Achim Ulmer, Gomadingen (DE)

(73) Assignee: H. Stoll GmbH & Co., Reutlingen (DE)

( * ) Notice: Subject to any disclaimer, the term of this patent is extended or adjusted under 35 U.S.C. 154(b) by 0 days.

(21) Appl. No.: 09/577,534

(22) Filed: May 24, 2000

(30) Foreign Application Priority Data

May 28, 1999 (DE) ..... 199 24 503

(51) Int. Cl.[7] ..... D04B 7/00
(52) U.S. Cl. ..... 66/69; 66/70; 66/176
(58) Field of Search ..... 66/64, 69, 70, 66/60 R, 176, 71, 76, 175

(56) References Cited

U.S. PATENT DOCUMENTS

| | | | | | |
|---|---|---|---|---|---|
| 3,640,097 | A | * | 2/1972 | Betts et al. | 66/176 |
| 3,695,063 | A | * | 10/1972 | Betts et al. | 66/176 |
| 3,702,068 | A | * | 11/1972 | Betts et al. | 66/176 |
| 3,882,697 | A | * | 5/1975 | Betts et al. | 66/176 |
| 4,197,724 | A | * | 4/1980 | Robinson et al. | 66/176 |
| 5,692,399 | A | | 12/1997 | Takahashi et al. | |
| 5,826,445 | A | | 10/1998 | Okamoto | |
| 5,916,272 | A | | 6/1999 | Nonnenmacher | |
| 5,987,930 | A | | 11/1999 | Nakai | |
| 6,006,551 | A | | 12/1999 | Nonnenmacher | |
| 6,286,340 | B1 | * | 9/2001 | Yui | 66/70 |

FOREIGN PATENT DOCUMENTS

| | | | | | |
|---|---|---|---|---|---|
| DE | 19652612 | A1 | * | 6/1998 | 66/64 |
| EP | 0522778 | A1 | * | 1/1993 | 66/64 |
| EP | 0857800 | A2 | * | 8/1998 | 66/64 |
| EP | 0863238 | A2 | * | 9/1998 | 66/64 |
| GB | 2 228 750 | A | | 9/1990 | |
| GB | 2309981 | A | * | 8/1997 | 66/64 |

* cited by examiner

*Primary Examiner*—Danny Worrell
(74) *Attorney, Agent, or Firm*—Michael J. Striker

(57) ABSTRACT

Disclosed is a method of producing tubular knitted articles for ready-to-wear clothes pieces, on a flat knitting machine with at least two oppositely located needle beds and a carriage with at least three knitting systems. In a first carriage passage narrowing of a knitted piece suspended on a front needle bed in one edge region, stitch formation for a knitted piece suspended on a rear needle bed, and reduction of a rear knitted piece in an opposite edge region of the knitted piece are performed. In a second carriage passage narrowing of the rear knitted piece in one edge region, stitch formation for the front knitted piece, and narrowing of the front knitted piece in an opposite region of the knitted piece are performed. The two proceeding steps are repeated until a desired narrowing of a knitted product is provided.

4 Claims, 9 Drawing Sheets

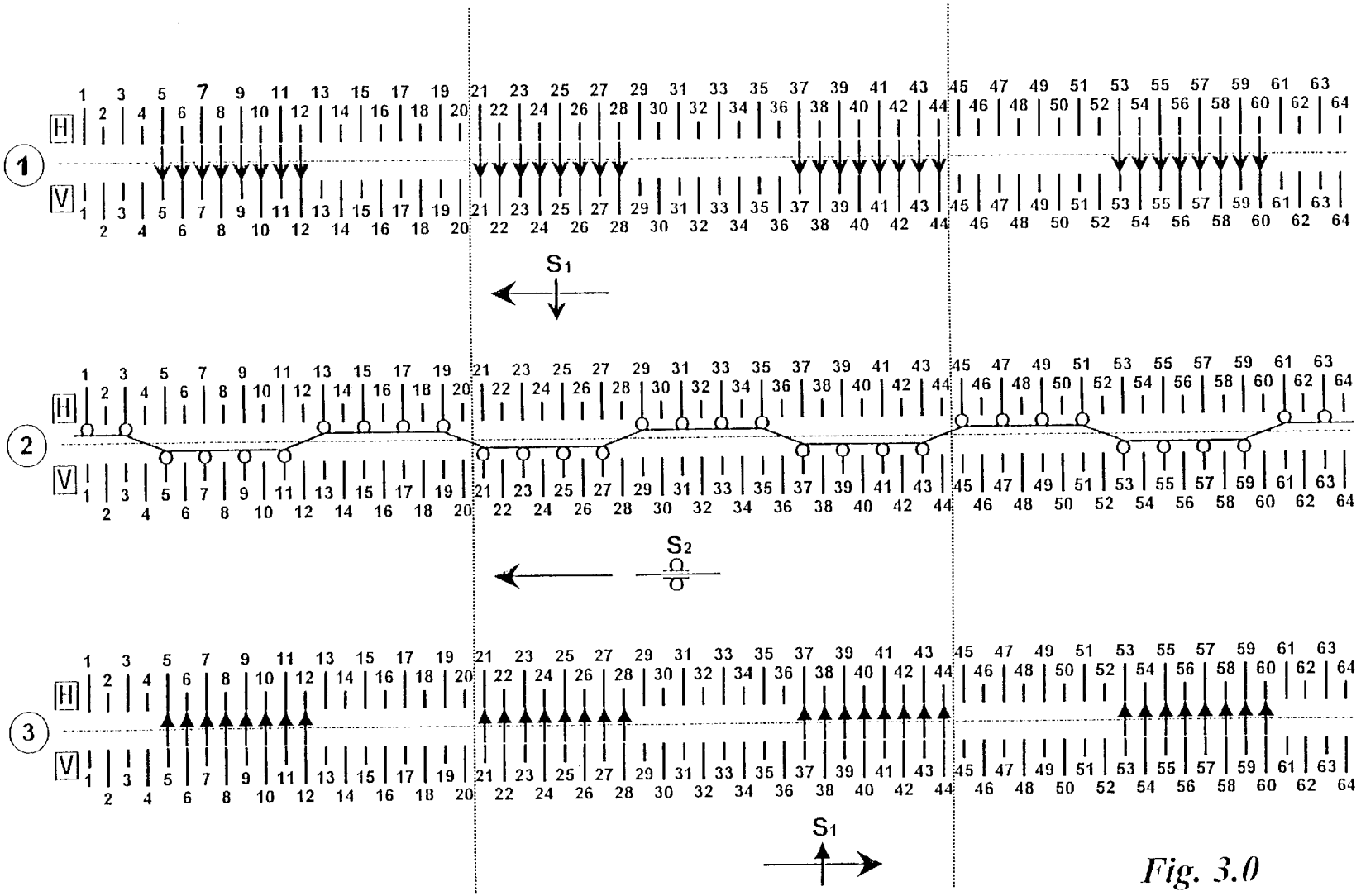
*Fig. 3.0*

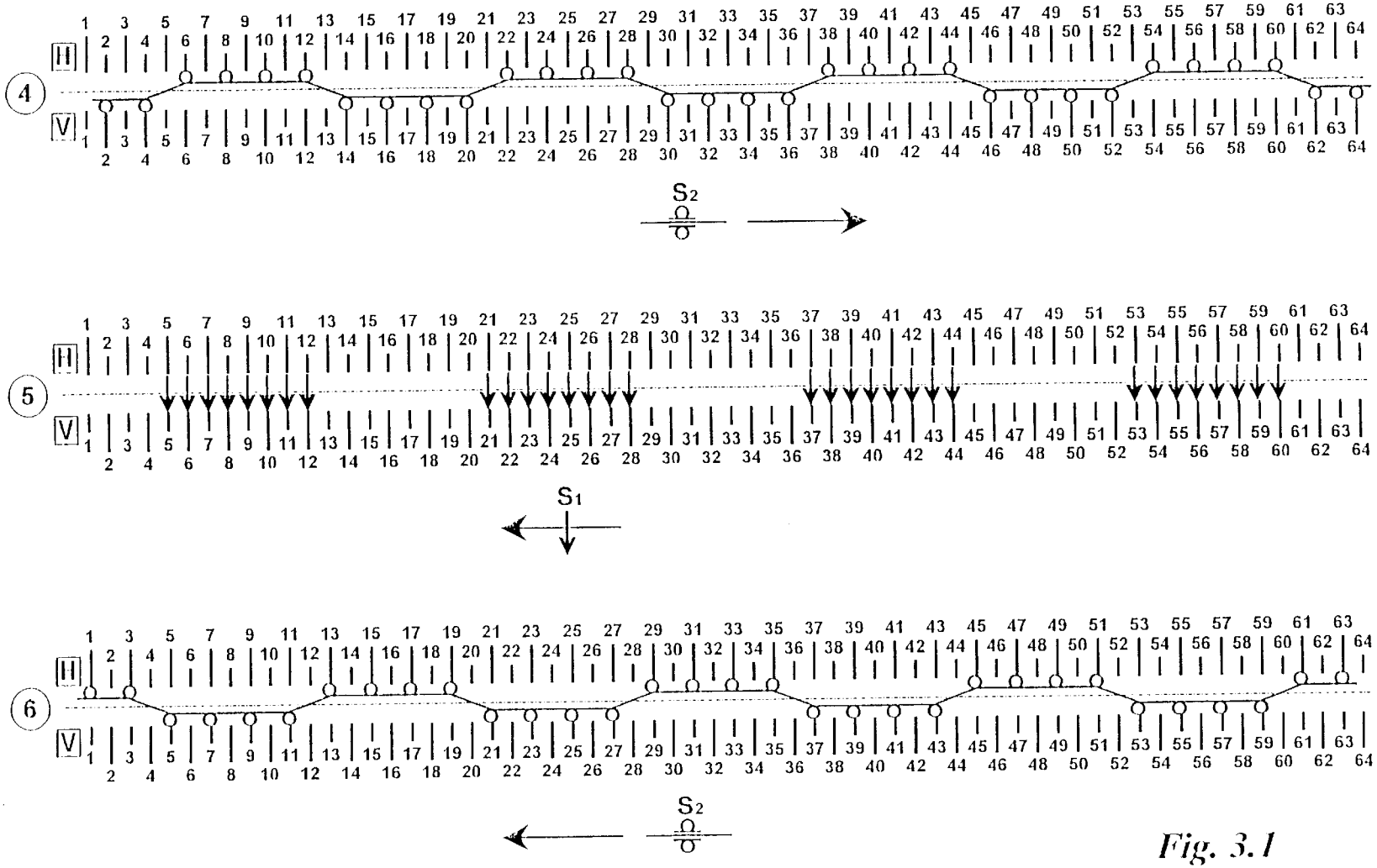
*Fig. 3.1*

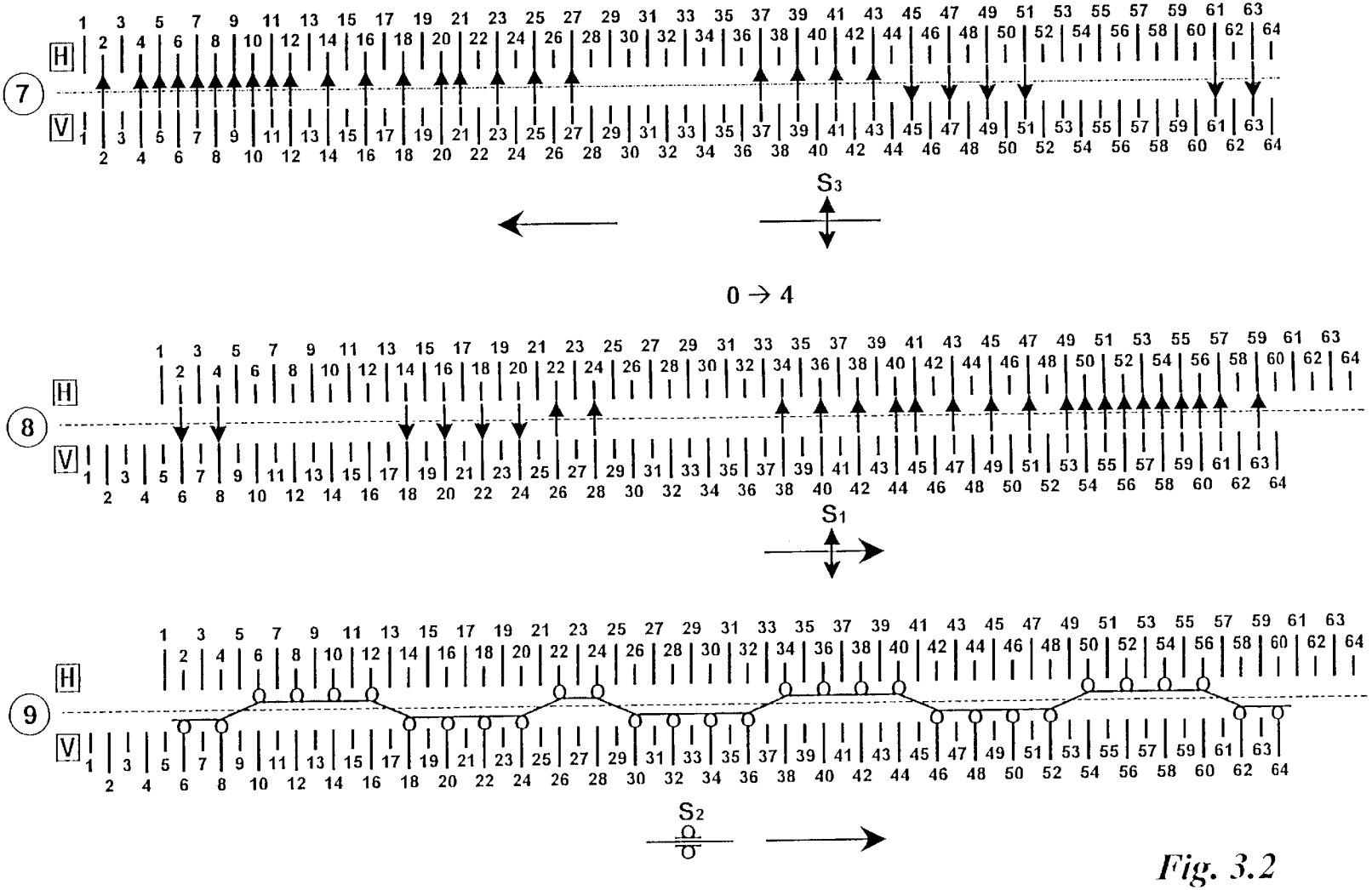
*Fig. 3.2*

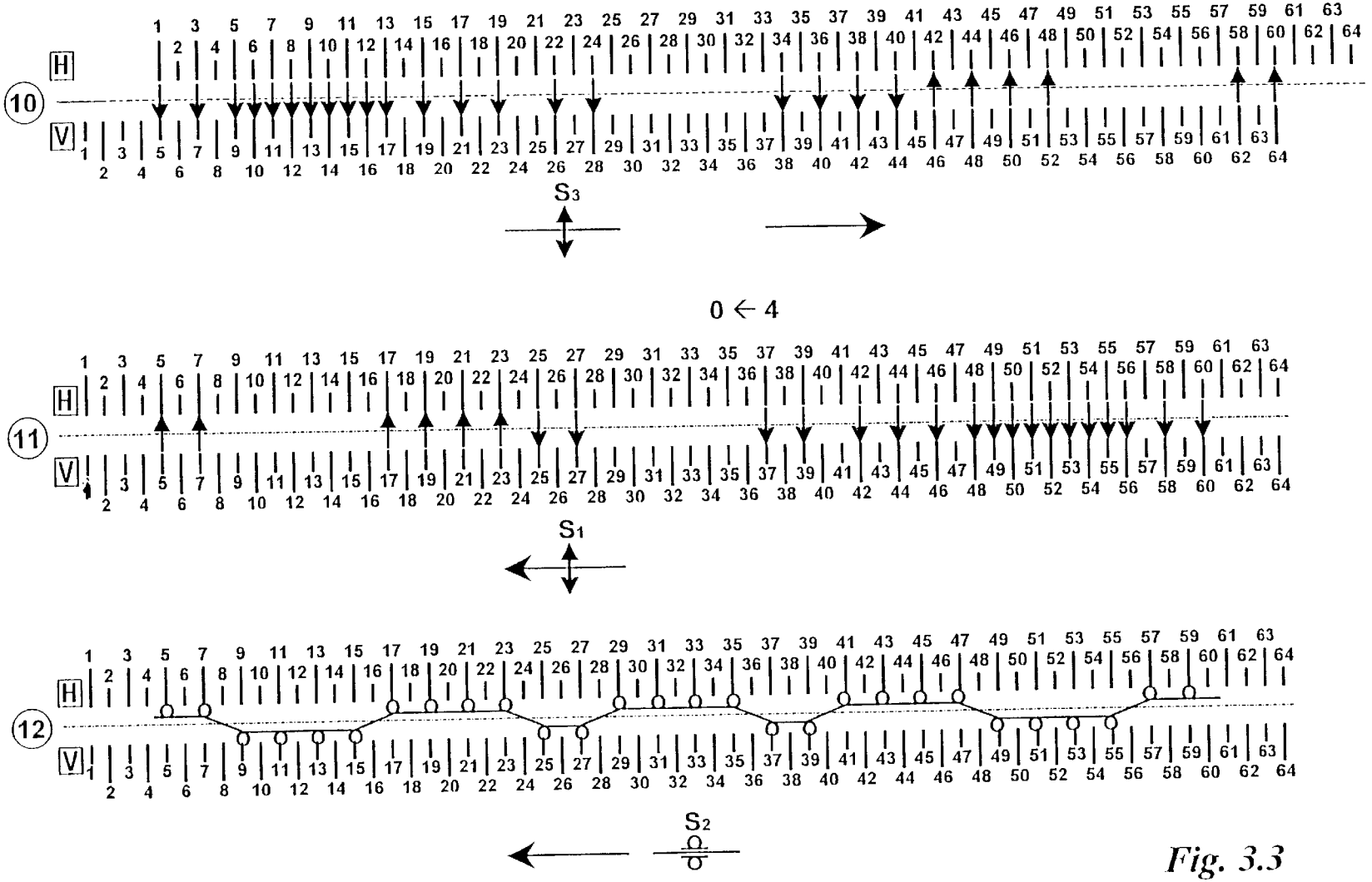
*Fig. 3.3*

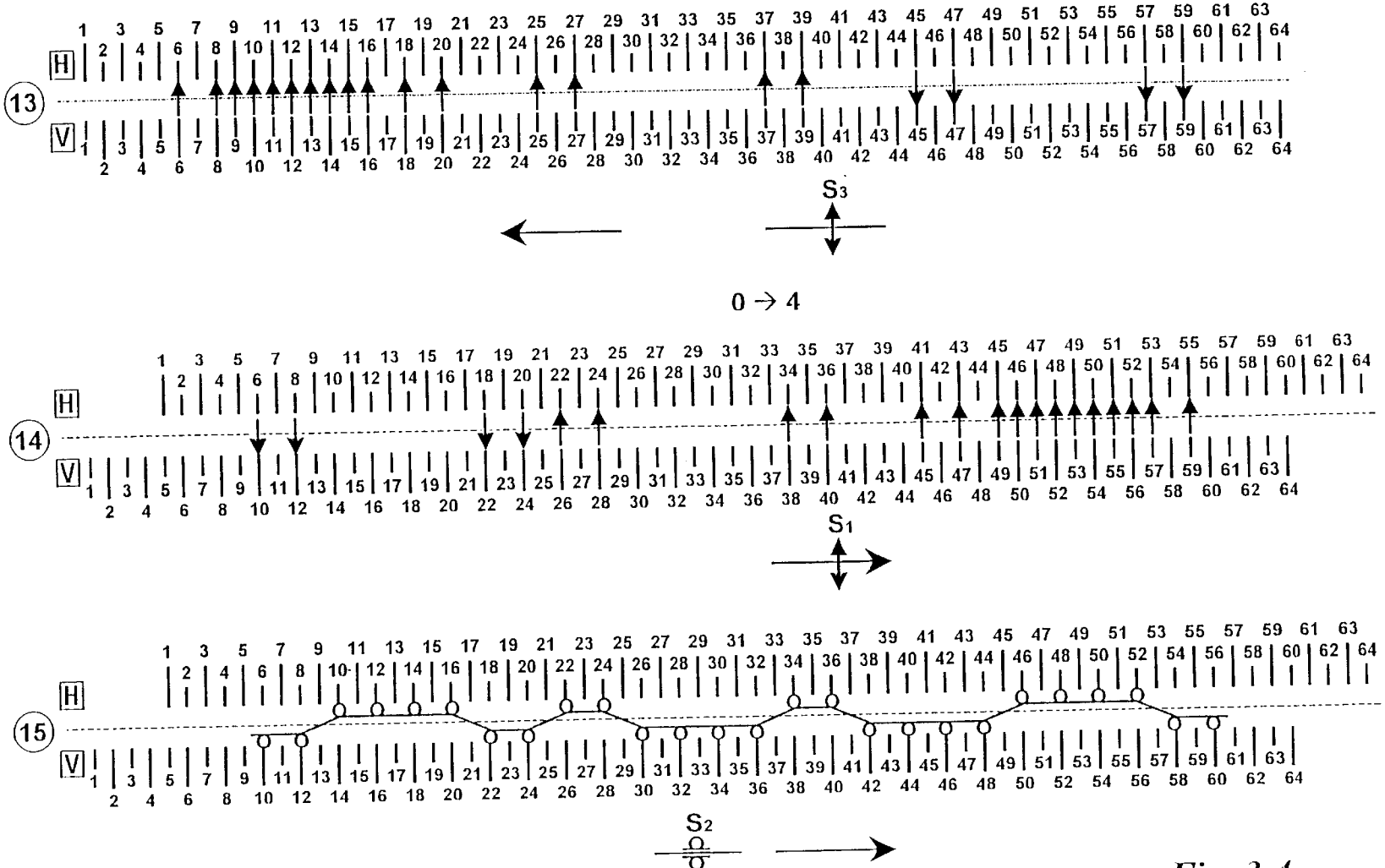
*Fig. 3.4*

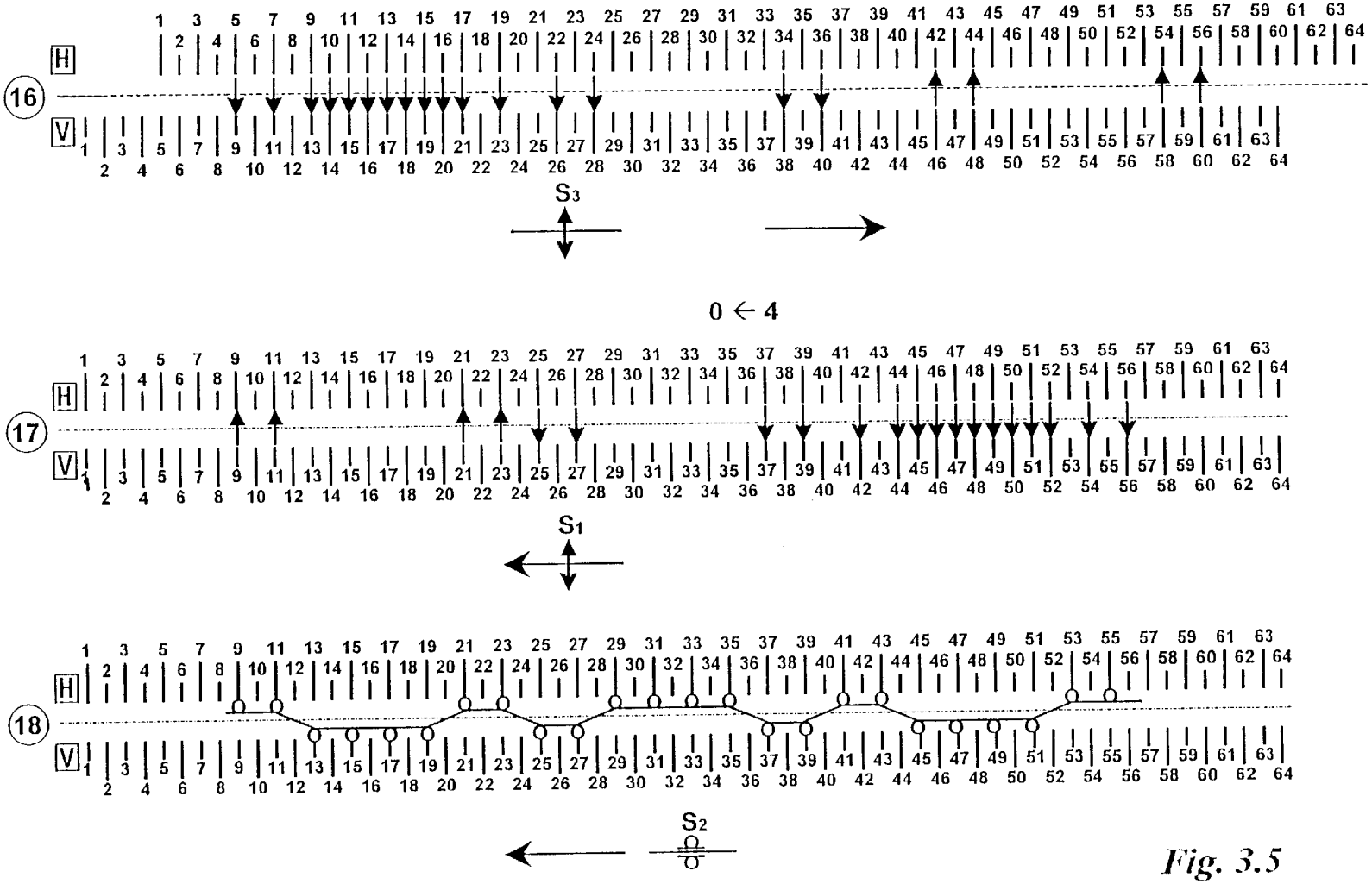
*Fig. 3.5*

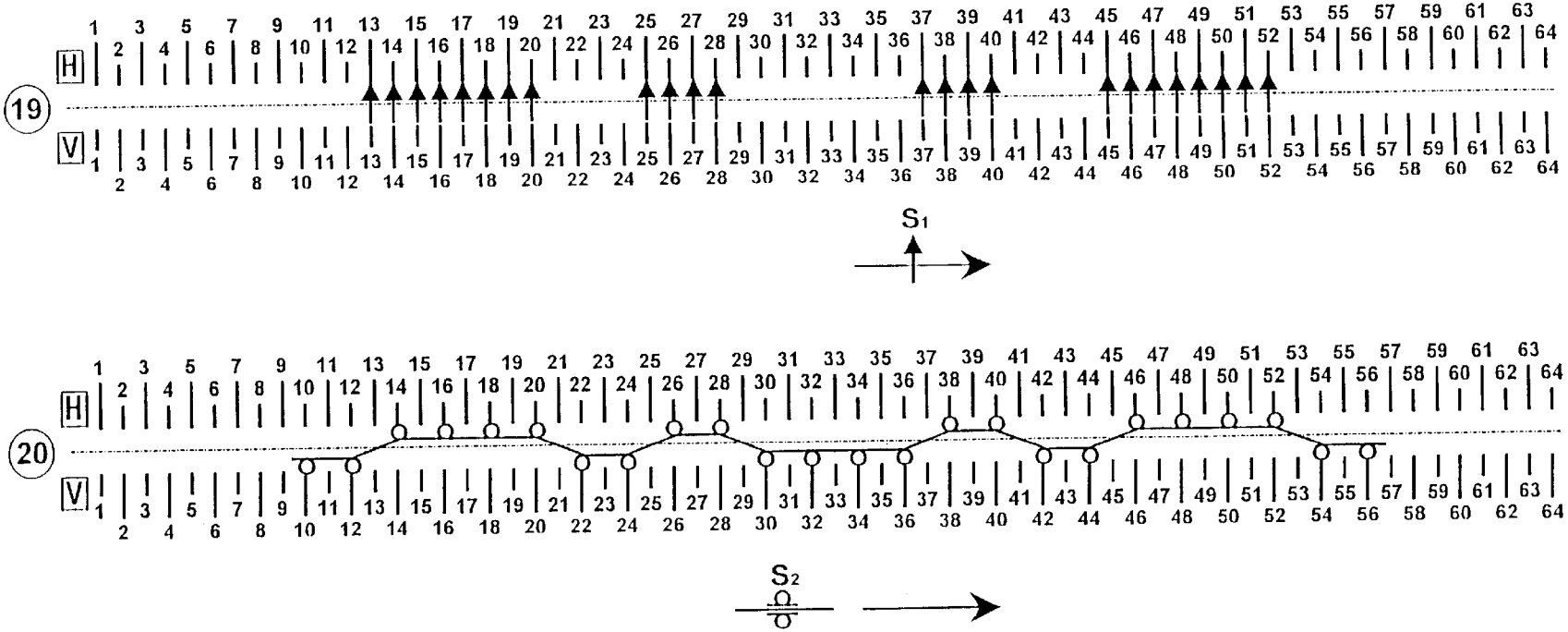
*Fig. 3.6*

METHOD FOR PRODUCING TUBULAR KNITTED ARTICLES ON A FLAT KNITTING MACHINE

BACKGROUND OF THE INVENTION

The present invention relates to a method for producing tubular knitted articles, in particular wear-ready clothes articles, on a flat knitting machine with at least two opposite needle beds and a machine carriage with at least three knitting systems, wherein the knitted articles have at least one region with narrowing of the stitch number and wherein at most with each second needle of one needle bed stitches are produced and correspondingly a stitch-carrying needle of the one needle bed extends outwardly beyond a free needle of the other needle bed.

In clothes articles which are produced as tubular articles ready-to-wear on the flat knitting machine, practically no more clothes works are performed, or in other words, they are relatively cost-favorable in the manufacture. This cost advantage however narrows when patterned-on-demand articles must be produced, whose contour corresponds to the shape of the body by expanding or reducing of the knitting rows. In particular during the reducing processes, additional carriage strokes for stitch transfer operations are required, which increase the knitting time for the clothes article.

SUMMARY OF THE INVENTION

According, it is an object of present invention to provide a method for producing of tubular articles on a flat knitting machine, which provides a particularly rational process for reducing tubular knitted articles.

In keeping with these objects and with others which will become apparent hereinafter, one feature of the present invention resides, briefly stated, in a method of producing tubular articles on a flat knitting machine, in which in accordance with the present invention for both-side narrowing of the knitted article the following steps are performed:

a) In a first carriage passage
   narrowing of the knitted article suspended on the front needle bed on for example a left edge region, stitch formation for the knitted article suspended on the rear needle bed, and narrowing of the rear knitted article on the opposite, for example right edge region of the knitted piece;

b) In a second carriage passage
   narrowing of the rear knitted piece on for example a left edge region, stitch formation for the front knitted piece, and narrowing of the front knitted piece on the opposite, for example, right edge region of the knitted piece, c) Repetition of the steps a and b until the desired narrowing of the knitted article is obtained.

In this process the number of stitches, by which the knitted piece is narrowed can vary from one narrowing cycle to another narrowing cycle.

In accordance with the old method disclosed in the prior art, for narrowing of the tubular articles total four carriage passages were required. In a first carriage passage the stitches for the rear knitted article piece were formed, in a second carriage passage stitches for the front knitted piece were formed, in the third carriage passage the front knitted piece for example on the left edge region and the rear knitted piece for example on the right edge region are formed, and subsequently in a fourth passage the rear knitted piece was narrowed for example on the left edge region and the front knitted piece was narrowed for example on the right edge region.

In contrast to this method, the inventive method requires only two carriage passages. As a result, the production time of the knitted piece in the narrowing region is narrowed by 50% over the method in accordance with the prior art. This is obtained in that now during each carriage passage, stitches are formed, or in other words no carriage passes are required alone for the transfer processes. The inventive method can be performed for all binding types and for all narrowing types and processes, where tubular knitted articles are utilized.

Preferably, before the first carriage passage those stitches of the front knitted piece on the first edge region which take part in the narrowing process can be transferred to the rear needle bed and those stitches of the rear knitted piece on the second edge region which take part in the narrowing process can be transferred to the front needle bed and subsequently the both needle beds are offset relative to one another in correspondence with the desired narrowing before, during the first carriage passage with a first knitting system, the stitches of the front and rear knitted pieces which take part in the narrowing process are transferred back to the front and rear needle beds, with a second knitting system stitches for the rear knitted piece are formed and with the third knitting system those stitches of the front and rear knitted piece on the corresponding opposite edge region which take part in the narrowing process are transferred to the front and rear needle bed, and before the second carriage passage needle beds are again offset back to their initial position, before in the second carriage passage with a first knitting system those stitches of the front and rear knitted piece which take part in the narrowing process are transferred to the front and rear needle bed with a second knitting system stitching system stitches for the front knitted piece are formed, and with a third knitting system those stitches of the rear and front knitted piece which take part in the subsequent narrowing process are transferred to the front and rear needle bed.

In knitted pieces which on the visible side have both right and left stitches, for example for ribbed knitted articles, during transfer of the stitches which take part in the narrowing also a transfer of the left stitches of the front knitted piece to the rear needle bed and of the left stitches of the rear knitted piece on the front needle bed and then after the stitch formation back can be performed.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 3 is a schematic view of the stitch course for production of a narrowing in a knitted piece of FIGS. 1*a* and 1*b*.

DESCRIPTION OF PREFERRED EMBODIMENTS

Figure 1:
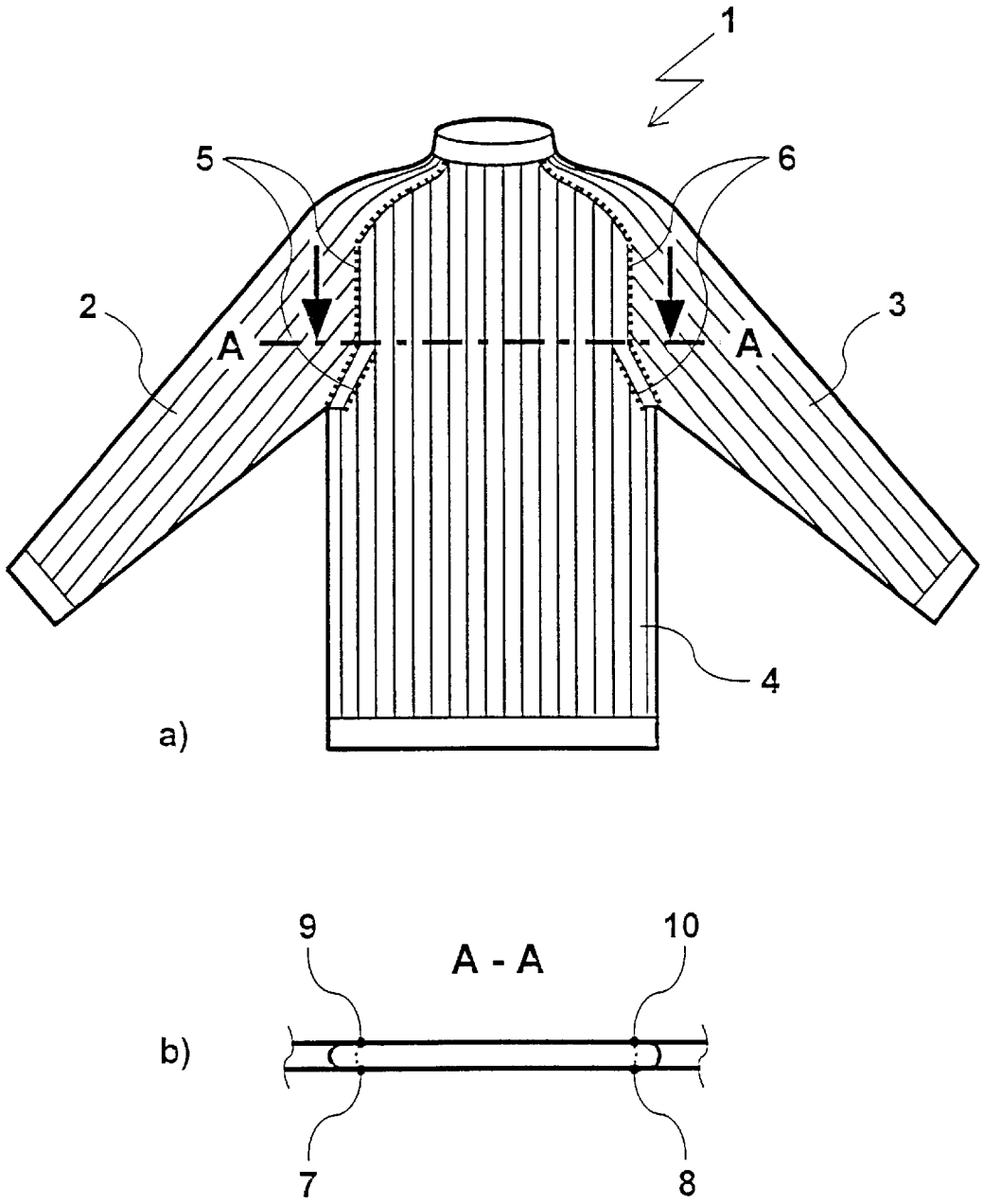
FIG. 1*a* is a front view of a sweater produced in accordance with the present invention.
FIG. 1*b* is a view showing a cross-section through the sweater of FIG. 1 taken along the line A—A.

A sweater 1 shown in FIG. 1*a* has a tubular knitted piece of a body part 4 and tubular knitted pieces for sleeves 2 and 3. In the initial points of the sleeves 2, 3 at the body part 4, stitch reducing regions 5 and 6 are provided. As shown in FIG. 1*b*, the narrowing of the knitted piece 1 must be performed at four points, namely the left and right edge region 7, 8, of the front knitted piece and the edge regions 9, 10 of the rear knitted piece.

Figure 2:
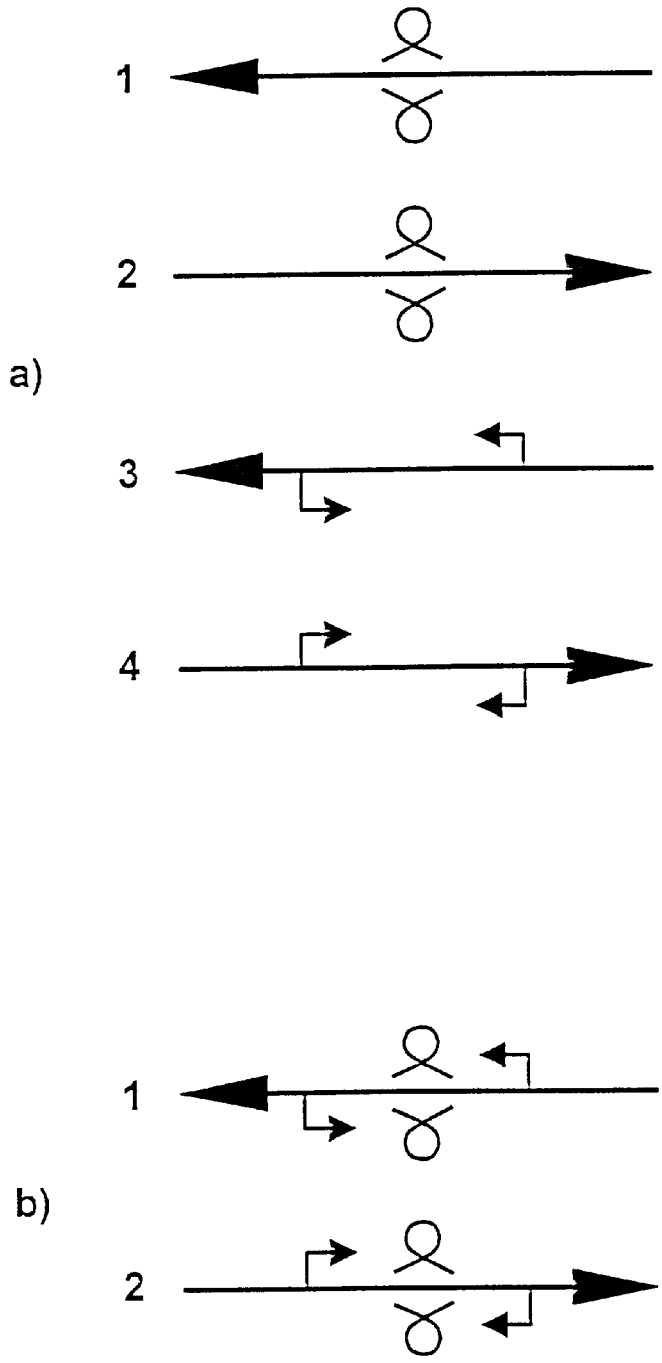
FIG. 2*a* is a schematic view of the narrowing process of a knitted piece in accordance with the prior art.
FIG. 2*b* is a view showing the reducing process in accordance with applicant's invention in an illustration corresponding to that of FIG. 2*a*.

FIG. 2 illustrates the method in accordance with the prior art. In this method during a first carriage passage, stitches for the rear knitted piece are produced. In the second carriage passage stitches for the front knitted piece are produced. Subsequently in a third carriage passage the front knitted piece narrows at the left and the rear knitted piece narrows at the right. In a fourth carriage passage then the front knitted piece is narrowed in the right edge region and the rear knitted piece is narrowed in the left edge region. The carriage passages 3 and 4 are therefore such carriage passages during which no stitches are produced and which do not contribute to the production of the knitted piece.

In contrast, in accordance with the method of the present invention illustrated in FIG. 2*b*, in a first carriage passage both the narrowing of the rear knitted piece on the right side, the front knitted piece on the left side and also the stitch formation for the rear knitted piece are performed. In a second carriage passage then the rear knitted piece on the left side and the front knitted piece on the right side are narrowed and the stitches for the front narrow piece are formed. Here no carriage passages are performed which can not be used also for stitch formation. This rational type of the narrowing is possible with all flat knitting machines which have two opposite needle beds and at least three knitting systems.

FIG. 3 shows an example of an inventive method for producing a ribbed knitted clothes pieces with a body part and a left and a right sleeve. For each knitting row the stitch course is illustrated. The needles which carry the stitches of the front and rear needle beds V and H are identified with long lines, and those which carry no stitches are identified with short lines.

The rows 1–4 describe the production of the stitch rows of constant width. In row 1 with a first knitting system S1, stitches which on the visible side of the rear knitted piece are left stitches are transferred to the front needle bed V. In row 2, with a second knitting system S2 with all needles which form the rear knitted piece, stitches are knitted. Subsequently in row 3 in opposite carriage direction with the knitting system S1, the produced left stitches for the rear knitted piece and corresponding stitches which are on the visible side of the front knitted piece are left stitches, are transferred to the rear needle bed H. In row 4 then with the second knitting system S2 with all needles which form the front knitted piece, stitches are formed.

The subsequent knitting rows 5–7 describe the transition for narrowing of the front and rear knitted pieces. In row 5 with the first knitting system S1 those stitches which are left stitches in the front and rear knitted piece are transferred to the front needle bed V. In row 6 with the second knitting system S2 with all needles which form the rear knitted piece, stitches are knitted. In the seventh row, with a third knitting system S3, the left stitches of the rear knitted piece are transferred to the rear needle bed H. The stitches of the front knitted piece which take part in the narrowing process are also transferred to the rear needle bed H. The stitches of the rear knitted piece which take part in the narrowing process are transferred to the front needle bed V.

The rows 8–15 describe the narrowing process. In row 8 before the carriage movement, the rear needle bed is offset to the right by four needles. Subsequently with the first knitting system the stitches 2, 4, and 14–20 of the front knitted piece which are offset by four needles are transferred to the front needle bed V, and the stitches 26–44 as well as 54–60 of the front knitted piece are transferred in accordance with the pattern to the rear needle bed H. Moreover, the stitches 45, 47, 49, 51, 53, 55, 57, 59, 61 and 63 of the rear knitted piece which take part in the narrowing process are transferred back to the rear needle bed H. In row 9 the left side of the front knitted piece and the right side of the rear knitted piece are narrowed by two stitches. When the second knitting system S2 with all needles which form the knitted piece stitches are knitted before in row 10 with a third knitting system S3, the left stitches of the front knitted piece are transferred to the front needle bed V and the stitches of the rear knitted piece which took part in the narrowing process are transferred to the front needle bed V, and stitches of the front knitted piece which take part in the narrowing process are transferred to the rear needle bed H. Subsequently in row 11, before the carriage movement the rear needle bed is again displaced by four needles to the left in its base position. With the first knitting system S1, the stitches of the rear knitted piece in the left edge region which are offset on the four needles are transferred to the rear needle bed H, and the stitches of the front knitted piece in the right edge region are transferred to the front needle bed and the left stitches of the rear knitted article are also transferred to the front needle bed.

In row 12 the left side of the rear knitted piece and the right side of the front knitted piece are narrowed by two stitches. The formation of stitches with all needles which form the rear knitted piece is performed again with the second knitting system S2. In row 13 with the third knitting system S3 the stitches of the front knitted piece in the left edge region which take part in the narrowing process are transferred to the rear needle bed H and the stitches of the rear knitted piece in the right edge region which take part in the narrowing process are transferred to the front needle bed V and the left stitches of the rear knitting piece are transferred back to the rear needle bed H. Before the carriage movement in row 14 the rear needle bed is offset again by four needles to the right. Subsequently with the first knitting system S1 the stitches of the front knitted piece which take part in the narrowing reduction are transferred back to the rear needle bed V, and the left stitches for the front knitted piece are transferred to the rear needle bed H and the stitches of the rear knitted piece which take part in the narrowing process in the right edge region are transferred to the rear needle bed. In row 15 the left side of the front knitted piece and the right side of the rear knitted piece are narrowed by two stitches. Further, stitches are formed with the second knitting system S2 with all needles which form the front knitted piece. In row 16 with the third knitting system S3 a transfer is performed of the stitches of the rear knitted piece which take part in the narrowing process in the left edge region, and the left stitches or the front knitted piece to the front needle bed V, and the stitches of the front knitted piece which take part in the narrowing process in the right region are transferred to the rear needle bed.

The rows 17–20 describe the transition of the narrowing regions to a knitted portion with a constant knitted width. For this purpose in row 17 before the carriage movement the rear needle bed is again offset by four needles to the left to its basic position. Subsequently with the first knitting system S1 the stitches of the rear knitted piece which take part in the narrowing process in the left edge region are transferred to the rear needle bed H, and the left stitches of the rear knitted piece are transferred to the front needle bed V and the stitches of the front knitted piece which take part in the narrowing process at the right side are transferred to the front needle bed V. The left side of the rear knitted piece and the right side of the front knitted piece are narrowed thereby by two stitches. Then stitches are knitted in row 18 with the second knitting system S2 with all needles which form the rear knitted piece. In row 19 with the first knitting system S1 a transfer of the left stitches for the rear knitted article and those stitches which are left stitches in the front knitted piece is performed to the rear needle bed H. After these stitches are knitted in row 20 with the second knitting system S2 with all needles which form the front knitted piece. Subsequently, the pattern-dependent transfer of the stitches and the knitting-off are again advanced, until the next narrowing region of the knitted article is reached.

It will be understood that each of the elements described above, or two or more together, may also find a useful application in other types of methods and constructions differing from the types described above.

While the invention has been illustrated and described as embodied in method for producing tubular knitted articles on a flat knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A method of producing tubular knitted articles for ready-to-wear clothes pieces, on a flat knitting machine with at least two oppositely located needle beds and a carriage with at least three knitting systems, wherein the knitted articles have at least a region with a narrowing of a stitch number and wherein at most with each second needle of one needle bed stitches are produced and a corresponding needle of one needle bed which carries a stitch is located opposite to a free needle of another needle bed, wherein for both-side narrowing of the knitted piece the following steps are performed:

a) in a first carriage passage
narrowing of a knitted piece suspended on a front needle bed in one edge region; stitch formation for a knitted piece suspended on a rear needle bed, and reduction of a rear knitted piece in an opposite edge region of the knitted piece;

b) in a second carriage passage
narrowing of the rear knitted piece in one edge region, stitch formation for the front knitted piece, and narrowing of the front knitted piece in an opposite region of the knitted piece;

c) repeating the steps a) and b) until a desired narrowing of a knitted product is provided.

2. A method as defined in claim 1, wherein said one edge region and another edge region in the step a) are left edge region and a right edge region of the knitted piece, while said one edge region and said another edge region in the step b) are a left edge region and a right edge region.

3. A method as defined in claim 1; and further comprising the following steps: transferring before a first carriage passage those stitches of the front knitted piece in a first edge region which take part in a narrowing process to the rear needle bed, and transferring those stitches of the rear knitted piece in a second edge region which take part in a narrowing process to the front needle bed; subsequently displacing both needle beds in correspondence with a desired pattern relative to one another prior to transferring back during the first carriage passage with a first knitting system of the stitches which take part in the narrowing process of the front and rear knitted piece to the front and rear needle beds; forming stitches for the rear knitted piece with a second knitting system; transferring with a third knitting system those stitches of the front and rear knitted pieces at corresponding oppositely located edge regions which take part in the narrowing process, to the rear and front needle beds; displacing back the needle beds to their initial position before second carriage passage, before in the second carriage passage with the first knitting system those stitches of the front and rear needle pieces which take part in a narrowing process are transferred back to the front and rear needle beds; forming stitches for the front knitted piece with a second knitting system; transferring with a third knitting system those stitches of the rear and front knitted piece which take part in a subsequent narrowing process, to the front and rear needle beds.

4. A method as defined in claim 1; and further comprising the steps of performing, during transfer of stitches which take part in the narrowing in the knitted pieces which have right and left stitches on a visible side, also a transfer of the left stitches of the front knitted piece to the rear needle bed and the left stitches of the rear knitted piece to the front needle bed; and after a stitch formation, transferring them back.

* * * * *